United States Patent [19]

Tsuda et al.

[11] 4,092,065

[45] May 30, 1978

[54] SCREEN DRUM TYPE ELECTROGRAPHIC APPARATUS HAVING A CORRECTING LENS TO PRODUCE AN IMAGE OF EQUAL LENGTH AND ASPECT RELATIVE TO THE ORIGINAL

[75] Inventors: Hiroshi Tsuda, Mitaka; Masaji Nishikawa; Katsuhiko Kimura, both of Hachioji; Eiichi Sato, Tama, all of Japan

[73] Assignee: Olympus Optical Company Limited, Tokyo, Japan

[21] Appl. No.: 708,264

[22] Filed: Jul. 23, 1976

[30] Foreign Application Priority Data

Jul. 29, 1975 Japan ..... 50-92307

[51] Int. Cl.[2] ..... G03G 15/28

[52] U.S. Cl. ..... 355/8; 355/11

[58] Field of Search ..... 355/8, 55, 60, 3 SC, 355/11

[56] References Cited

U.S. PATENT DOCUMENTS 4,021,109 5/1977 Tanaka et al. ..... 355/8

FOREIGN PATENT DOCUMENTS 2,424,720 12/1974 Germany ..... 355/3 SC

*Primary Examiner*—Richard L. Moses

*Attorney, Agent, or Firm*—Haseltine, Lake & Waters

[57] ABSTRACT

An improved screen drum type electrographic apparatus which can obtain a picture image having a correct aspect ratio is disclosed. The apparatus comprises a cylindrical lens arranged in an optical passage including an optical system for scanning a manuscript such as printed matter disposed on a table. The cylindrical lens has such a radius of curvature that an image magnification in the scanning direction only is defined by 1/K (K>1) and a length which is sufficient to optically cover the scanning width of a screen drum or the manuscript. The apparatus is so constructed that the ratio of the peripheral speed of the screen drum to the moving speed of the manuscript table or the optical system for scanning manuscript is defined by 1/K.

3 Claims, 5 Drawing Figures

SCREEN DRUM TYPE ELECTROGRAPHIC APPARATUS HAVING A CORRECTING LENS TO PRODUCE AN IMAGE OF EQUAL LENGTH AND ASPECT RELATIVE TO THE ORIGINAL

FIELD OF THE INVENTION

This invention relates to improvements in a screen drum type electrographic apparatus, which comprises a photosensitive screen drum and can form a picture image on a record medium such as a record sheet fed along a rectilinear passage.

PRIOR ART

A technique is well known in the art of superimposing a photoconductive layer, an insulating layer, an electric conductive layer, etc. one upon the other and ahering these layers with each other to form a screen-shaped body, modulating a flow of ions by a difference between electric fields produced in or near meshes of the screen-shaped body by means of corona discharge, light image illumination, etc., and forming an electrostatic latent image on a dielectric record medium or selectively charging floating ink particles by means of a flow of ions so as to obtain a picture image on an ordinary sheet of paper.

In a conventional electrographic apparatus, it has been common practice to use a photosensitive drum, and to transfer a toner image from the photosensitive drum onto an ordinary sheet of paper or tranfer an electrostatic latent image from the photosensitive drum onto an electrostatic record medium. In these measures, the record medium is fed along the photosensitive drum in substantially closely contact with the latter. As a result, the peripheral speed of the photosensitive drum must be made equal to the feeding speed of the record medium. In addition, in these measures, that part of the photosensitive drum from which the toner image or the electrostatic latent image is transferred onto the record medium is limited to that range of the record medium which is in close contact with the photosensitive drum.

A screen drum type electrographic apparatus, which comprises a photosensitive screen drum and can form a picture image on a record medium, such as a record sheet, fed along a rectilinear passage, has also been well known in the art.

Experimental tests effected on such screen drum type elctrographic apparatus have yielded the result that in order to obtain a good picture image a charging width of a corona discharge device adapted to form a picture image on a record medium (hereinafter will be called a print corona discharge device), that is, a width of a flow of ions must be made extremely narrow. That is, if the charging width is wide, an electric charge dot constituting the picture image becomes widened, thereby substantially degrading the resolution of the picture image. On the contrary, if the charging width is narrow, the print speed must be made low, and as a result, it is impossible to provide a high speed recording apparatus. These problems which have been encountered with the conventional techniques are contrary to each other and hence it is very difficult to eliminate such problems.

The inventors have already proposed a screen drum type electrographic apparatus which is capable of effecting a high speed print operation with a possibly wide charging width without degrading the resolution of the picture image. Such screen drum type electrographic apparatus comprises a photosensitive screen drum rotatable at a constant speed, and a flat-shaped record medium opposed to the photosensitive screen drum and fed along a rectilinear passage at a constant speed, whereby a flow of ions is modulated by an electrostatic latent image produced on the photosensitive screen drum to form a picture image on the record medium, the feeding speed V of the record medium being selected to be in a range defined by $$v(1 + \frac{d}{2R}) \leqq V \leqq v\{(1 + \frac{d}{2R}) + \frac{2R + d}{24R}\theta'^2\}$$

where $v$ is the peripheral speed of the photosensitive screen drum, $d$ is the shortest distance between the photosensitive screen drum and the record medium, R is the radius of the photosensitive screen drum and $2\theta 40$ is the center angle of the photosensitive screen drum intercepting the width of the flow of ions measured on the record medium.

The screen drum type electrographic apparatus constructed as above described, however, has the disadvantage that the magnification of the picture image in the scanning direction of a manuscript, such as printed matter, that is, in the lengthwise direction thereof, is different from the magnification of the picture image in a direction perpendicular to the scanning direction of the manuscript, that is, in the widthwise direction thereof.

For example, if the ratio of the peripheral speed $v$ of the screen drum to the feeding speed V of the record medium is $$1:K = 1:(1 + \frac{d}{2R})$$

the radius R of the screen drum is 90 mm, the distance d between the screen drum and the record medium is 5 mm, and the length of the manuscript be 250 mm, then the length of the picture image formed after scanning is given by $$250 \times (1 + \frac{d}{2R}) = 250 \times (1 + \frac{5}{180}) = 256.94 \text{ mm.}$$

That is, the length of the picture image in the scanning direction becomes larger than the length of the manuscript by about 7 mm. This magnification value of the picture image in the scanning direction of the manuscript is relatively large if compared with the tolerance of size of a record sheet used as the record medium, thereby hindering correct recopying of drawings, etc. The dimension of the picture image in its widthwise direction perpendicular to the scanning direction is not changed at all, so that the above mentioned screen drum type electrographic apparatus has the disadvantage that there is a risk of picture images having different aspect ratios being produced.

SUMMARY OF THE INVENTION

An object of the invention, therefore, is to provide an improved screen drum type electrographic apparatus which can obviate the above mentioned disadvantage and can obtain a picture image having a correct aspect ratio.

A feature of the invention is the provision in a screen drum type electrographic apparatus comprising a photosensitive screen drum rotated at a constant speed, a flat-shaped record medium opposed to the photosensitive screen drum and fed along a rectilinear passage at a constant speed, a table for supporting a manuscript such as printed matter therein, and an optical passage including an optical system for scanning the manuscript and a projecting lens, a ratio of the peripheral speed of the photosensitive screen drum to the feeding speed of the record medium being defined by 1:K (K>1), whereby a manuscript image is projected through the optical passage onto the screen drum by means of the projecting lens to form an electrostatic picture on the screen drum and a flow of ions directed through the screen drum toward the record medium is modulated by means of the electrostatic picture image formed on the screen drum to form a picture image on the record medium, the improvement in which the optical passage comprises a cylindrical lens having such a radius of curvature that an image magnification in the scanning direction only is defined by 1/K and a length which is sufficient to optically cover the scanning width and in which the ratio of the peripheral speed of the screen drum to the moving speed of the manuscript table or the optical system for scanning the manuscript is defined by 1:K.

BRIEF DESCRIPTION OF THE DRAWING

The invention will now be described in greater detail with reference to the accompanying drawings, wherein.

DETAILED DESCRIPTION

Figure 1:
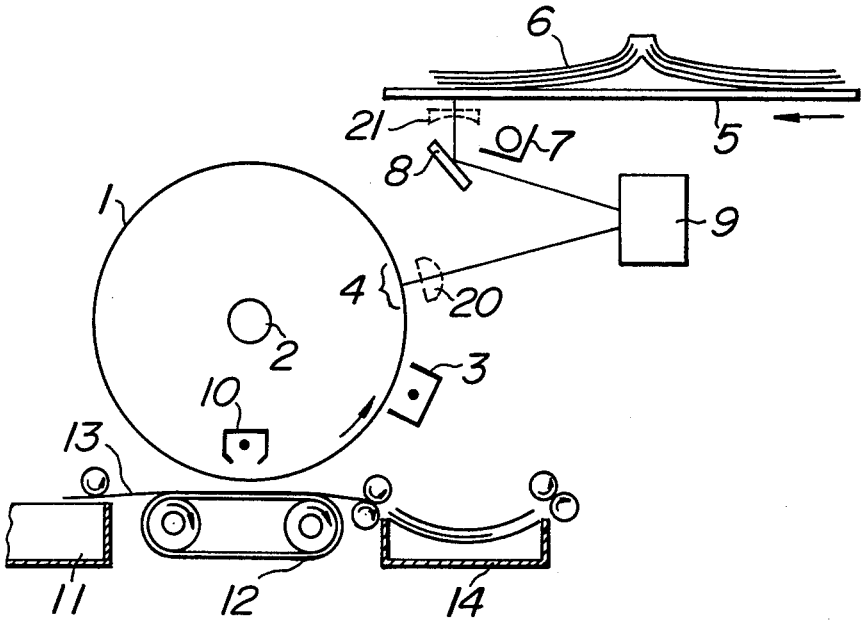
FIG. 1 is a diagrammatic view showing one embodiment of a screen drum type electrographic apparatus according to the invention.

Referring to FIG. 1 showing one embodiment of the screen drum type electrographic apparatus according to the invention, a screen drum 1 consists of a photoconductive layer, an insulating layer and an electric conductive layer which are superimposed one upon the other and formed into a cylindrical screen shaped body. The screen drum 1 is rotatably mounted on a shaft 2 and rotated about the shaft 2 at a constant speed in a counterclockwise direction as shown by the arrow. Along the outer periphery of the screen drum 1 is arranged a first corona discharge device 3 which serves to uniformly charge the screen drum 1. Onto the uniformly charged screen drum 1 is further projected a manuscript image at its region 4 where a light image is illuminated. In order to project the manuscript image onto the region 4, a manuscript 6 such as printed matter is disposed on a table 5 which is movable in a horizontal direction as shown by the arrow and illuminated by a light source 7. The light reflected by the manuscript 6 is projected through an optical passage including a mirror 8 and a projecting lens 9 onto the region 4, an optical system for scanning the manuscript being constituted by the light source 7 and the mirror 8. The uniform charge on the screen drum 1 is discharged in response to the light image projected onto the region 4 to produce an electrostatic latent image corresponding to the manuscript image on the screen drum 1. The screen drum 1 is further rotated and becomes opposed to a record medium 13 fed in synchronism with the screen drum 1 from a record medium supply tank 11 by means of an endless belt conveyor 12 on the one hand and also opposed to a second print corona discharge device 10 arranged in the inner periphery of the screen drum 1 in opposition to the record medium 13 on the other hand. A flow of ions directed from the print corona discharge device 10 through meshes of the screen drum 1 toward the record medium 13 is modulated by the electrostatic latent image produced on the screen drum 1 to form a corresponding electrostatic latent image on the record medium 13. This record medium 13 is fed to a developing tank 14 where the electrostatic latent image on the record medium 13 is developed into a visual picture image. The screen drum 1 further continues its rotation and is uniformly charged again by the first corona discharge device 3. The above mentioned operations are repeated to successively form visual picture images on the record sheets 13.

In such screen drum type electrographic apparatus, the surface of the screen drum 1 bearing the electrostatic latent image travels along an arcuate passage, while the record medium 13 travels along a rectilinear passage. As a result, when the record medium 13 passes through the print region, electric charge dots formed on the record medium 13 become widened and hence the resolution of the picture image is degraded.

Figure 2:
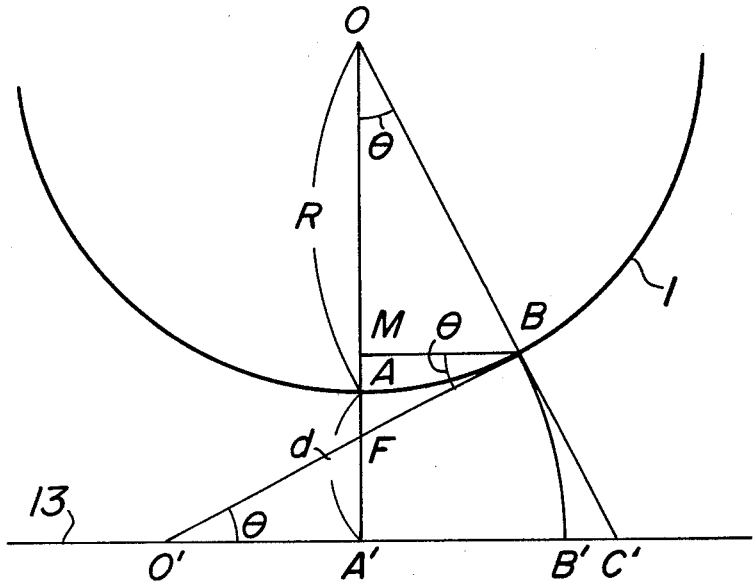
FIG. 2 is a diagrammatic view showing a relation between a screen drum and a record medium shown in FIG. 1 in an enlarged scale.

Such widening phenomenon of the electric charge dots will now be described with reference to FIG. 2 diagrammatically showing the screen drum 1 and the record medium 13 on an enlarged scale.

Assume the peripheral speed of the screen drum 11 be $v$ and assuming that the record medium 13 is fed along a rectilinear passage at the same speed $v$. The flow of ions passed through the screen drum 1 travels along an arcuate passage which crosses at right angles with both the screen drum 1 and the record medium 13. This fact can be proved by solving Poisson's equation and by using a theory of conformal representation. That is, in FIG. 2, the flow of ions passing through any point B on the screen drum 1 travels along an arc BB' having a radius O'B' extending from a point O' where a tangent drawn at the point B crosses with the record medium 13. As a result, the dimension of the widened electric charge dot formed on the record medium 13 is equal to an amount given by subtracting a real travelling distance $\widehat{AB}$ of the record medium 13 from a distance $\overline{A'B'}$. This amount will be called an amount of smear $\delta$ and given by $$\delta = \overline{A'B'} - \widehat{AB}.$$

In order to reduce the widened dot, that is, the amount of smear $\delta$ so as to improve the resolution of the picture image, the print region, that is, the charging width of the print corona discharge device 10 may be made narrow. The use of such measure, however, provides the important disadvantage that both the rotating speed of the screen drum 1 and the feeding speed of the record medium 13 must be lowered and hence the recording speed becomes low.

In order to obviate such disadvantage, it might be considered to feed the record medium 13 along an arcuate passage which is concentric with the screen drum 1 instead of feeding it along the rectilinear passage at a speed of $$\left(\frac{R+d}{R}\right)$$

times higher than the speed of the screen drum 1 where R is a radius of the screen drum 1 and $d$ is a distance between the screen drum 1 and the record medium 13. Such measure, however, makes mechanisms for feeding and guiding the record medium 13 complex in construction and hence is not suitable for practical use.

It might also be considered to guide the record medium 13 along an arcuate passage which is symmetrical with respect to the screen drum 1 at the same speed as the speed of the screen drum 1. In this case also, the apparatus becomes complex in construction and large in size.

As can be seen from the above, the screen drum type electrographic apparatus designed to feed the record medium 13 along the arcuate passage becomes complex in construction and is not suitable for practical use. As a result, it is desirous to feed the record medium 13 along a rectilinear passage at least at a recording region as shown in FIG. 1. In this case, the feeding speed V of the record medium 13 is so related to the peripheral speed $v$ of the screen drum 1 as described above that the charging width of the print corona discharge device 10 is widened without degrading the resolution of the picture image and a high speed recording can be effected.

As shown in FIG. 2, the center of the screen drum 1 is denoted by O, its radius by R, the shortest distance between the screen drum 1 and the record medium by $d$, the center positions of the screen drum 1 and the record medium 13 by A and A', respectively, that point on the record medium 13 which corresponds to that point B located on the screen drum 1 when it is rotated by $\theta$ by B', and any other points necessary for explanation are denoted by letters as shown in FIG. 2. Between the screen drum 1 and a field electrode (not shown) for supporting the record medium 13 is applied an electrical field and the electric lines of force established by the electrical field are perpendicular to both the screen drum surface and the record medium surface. Thus, the electric lines of force are formed at the center part along the straight line AA' and formed at the point B along an arc B—B' having a center O' where a tangent drawn at the point B of the drum 1 crosses with the record medium surface. The flow of ions travels along these electric lines of force.

The segment $\overline{A'B'}$ shown in FIG. 2 is obtained by the following calculation.

$$\overline{A'B'} = \overline{O'B'} - \overline{O'A'} = \overline{O'B} - \overline{O'A'} \tag{1}$$

$$\overline{O'B}\tan\theta = \overline{BC} = \overline{OC} - \overline{OB} = \frac{(R+d)}{\cos\theta} - R$$

Thus, $$\overline{O'B'} = \overline{O'B} = \frac{\left\{\frac{(R+d)}{\cos\theta} - R\right\}}{\tan\theta} \tag{2}$$

Also, $$\overline{O'A'}\tan\theta = \overline{A'F}$$

-continued $$\overline{A'F} = \overline{A'M} - \overline{MF}$$

$$= [(R+d) - R\cos\theta] - \overline{MB}\tan\theta$$

$$= (\overline{OA'} - \overline{OM}) - \overline{MF}$$

$$= (R+d) - R\cos\theta - R\sin\theta\tan\theta$$

Accordingly, $$\overline{O'A'} = \frac{\{(R+d) - R\cos\theta - R\sin\theta\tan\theta\}}{\tan\theta} \tag{3}$$

From the above equations (1), (2) and (3), $$\overline{A'B'} = \overline{O'B'} - \overline{O'A'} = \frac{\left\{\frac{(R+d)}{\cos\theta} - R - (R+d) + R\cos\theta + R\sin\theta\tan\theta\right\}}{\tan\theta} \tag{4}$$

The above equation (4) can be approximated into the following equation (5).

$$\overline{A'B'} \simeq R\left(1+\frac{d}{2R}\right)\theta + \left(\frac{2R+d}{24}\right)\theta^3 = R\theta\left(1+\frac{d}{2R}\right) + R\theta\left(\frac{2R+d}{24R}\right)\theta^2 \tag{5}$$

Let the rotary peripheral speed of the screen drum 1 be $v$, the above equation may be rewritten as $$\overline{A'B'} \simeq vt\left(1+\frac{d}{2R}\right) + vt\left(\frac{2R+d}{24R}\right)\theta^2 \tag{5}$$

Figure 3:
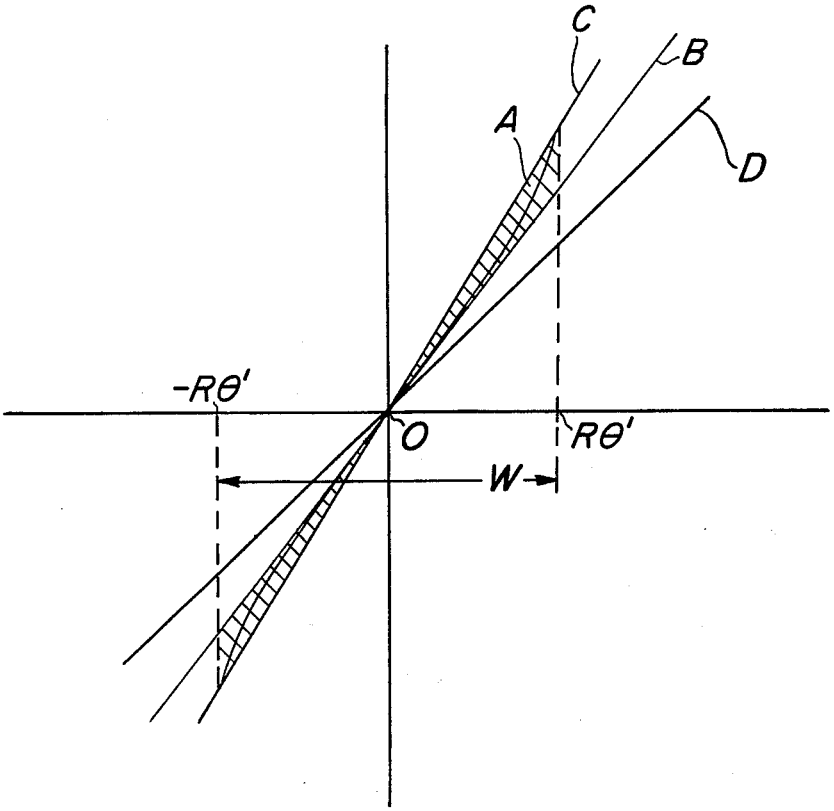
FIG. 3 is a graph showing a range of a speed ratio of the screen drum to the record medium shown in FIG. 1.

If $R\theta$ is plotted on the abscissa and $\overline{A'B'}$ is plotted on the ordinate, the above equation (5) is shown by the curve A in FIG. 3.

Now considering any one electric charge dot, if the feeding speed of the record medium 13 is not constant but changed as shown by the curve A, the widening of the dot can be eliminated. In practice, however, a number of dots are printed on the record medium at the same time, so that the other dots become widened. As a result, the record medium is obliged to be fed at a constant speed.

In the equation (5), the straight line represented by the first term of the right side, that is, $$\overline{A'B'} = R\theta\left(1+\frac{d}{2R}\right)$$

is defined by a straight line B in FIG. 3. In addition, let that value of $\theta$ which corresponds to a given print width W be $\theta'$, then the straight line defined by the equation (5), that is, $$\overline{A'B'} = R\theta\left(1+\frac{d}{2R}\right) + R\theta\left(\frac{2R+d}{24R}\right)\theta'^2 \tag{5'}$$

is shown by the straight line C in FIG. 3. As shown by a hatched zone, if the straight line $\overline{A'B'}$ is within a range between the straight lines B and C, the widening of the dot becomes extremely small, and as a result, even when a sufficiently wide print width W is used, a picture image having a high resolution can be formed on the record medium and the recording operation can also be effected at a high speed.

In FIG. 3, a straight line D shows $\overline{A'B'}$ when the record medium 13 is fed at a speed which is the same as the peripheral speed of the drum 1.

If the ratio of the peripheral speed of the screen drum to the feeding speed of the record medium is defined by a ratio of $\overline{A'B'}$ to $R\theta$, it is possible to make the widening of the dot small. As a result, by rewriting $\overline{A'B'}$ in the above equation (5') to $Vt$ and by rewriting $R\theta$ to $vt$, the following equation (6) can be obtained.

$$vt(1 + \frac{d}{2R}) \leqq Vt \leqq vt(1 + \frac{d}{2R}) + vt(\frac{2R + d}{24R})\theta'^2 \quad (6)$$

The equation (6) shows the relation between the length of $\overline{A'B'}$ and the corresponding length of $R\theta$. In order to define the ratio of the peripheral speed of the screen drum to the feeding speed of the record medium on the basis of the ratio given by the equation (6), the equation (6) is divided by the time $t$ to obtain the following equation (6') for defining the desirous speed ratio.

$$v(1 + \frac{d}{2R}) \leqq V \leqq v(1 + \frac{d}{2R}) + v(\frac{2R + d}{24R})\theta'^2 \quad (6')$$

Thus, by selecting the feeding speed V of the record medium 13 within a range defined by the equation (6'), it is possible to reduce the widening of the electric charge dot.

It is obvious from the above equation (6') that the feeding speed V of the record medium 13 should be at least $$(1 + \frac{d}{2R})$$

times higher than the peripheral speed $v$ of the screen drum 1. In the equation (5), the second term $$(\frac{2R + d}{24})\theta^3$$

shows the widening of the dot which could not be obviated if the record medium 13 is fed at the same speed as the screen drum 1.

The screen drum 1 is rotated at a constant speed and the record medium 13 is also fed at a constant speed, so that the widening of the dot due to the second term $$(\frac{2R + d}{24})\theta^3$$

of the equation (5) could not completely be obviated. But, it is possible to reduce the widening of the dot to such an extent that the widening of the dot is negligible in practice.

As can be seen from the above, if the ratio of the peripheral speed $v$ of the screen drum 1 to the feeding speed V of the record medium 13 is defined by $$1/K$$

where K is given by $$(1 + \frac{d}{2R}) \leqq K \leqq \{(1 + \frac{d}{2R}) + (\frac{2R + d}{24R})\theta'^2\}$$

the widening of the electric charge dot can be reduced to such an extent that the widening of the dot is negligible of consideration in practice.

As described above, the screen drum type constructed as above described, however, has the disadvantage that there is a risk of picture images having different aspect ratios being produced due to the fact that the magnification of the picture image in the scanning direction of the manuscript in the lengthwise direction thereof is different from the magnification of the picture image in a direction perpendicular to the scanning direction of the manuscript, that is, in the widthwise direction thereof.

In the present invention, in order to obviate such disadvantage, use is made of a cylindrical lens having a large radius of curvature and composed of synthetic resin, etc. The cylindrical lens is arranged in the image projecting optical passage and has such a radius of curvature that an image magnification in the scanning direction only is 1/K and a length which is sufficient to optically cover the scanning width. In addition, the ratio of the peripheral speed of the screen drum 1 to the moving speed of the manuscript 6 (i.e. the relative speed of manuscript 6 and optical system 7,8) or the optical system 7, 8 for scanning the manuscript 6 is defined by 1/K.

Figure 4:
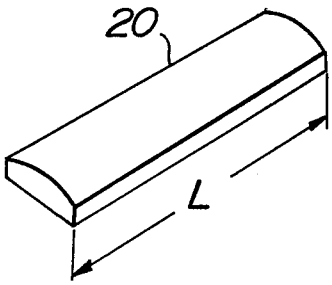
FIG. 4 is a perspective view showing a convex cylindrical lens used for the apparatus shown in FIG. 1.

In FIG. 4 is shown one embodiment of the cylindrical lens according to the invention. In this embodiment, the cylindrical lens is composed of a convex cylindrical lens 20 formed of synthetic resin, etc. The convex cylindrical lens 20 is arranged between the projecting lens 9 and the screen drum 1 as shown by dotted lines in FIG. 1. This convex cylindrical lens 20 has such a radius of curvature that an image magnification in the scanning direction only of the screen drum 1 is defined by 1/K and the lens has a length L which is sufficient to optically cover the width of the screen drum 1, the length L being measured in a direction perpendicular to the scanning direction of the screen drum 1.

Figure 5:
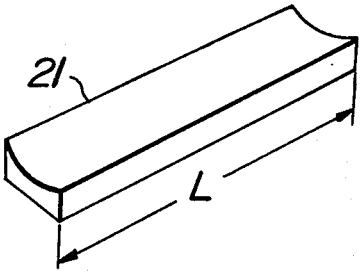
FIG. 5 is a perspective view showing a concave cylindrical lens used for the apparatus shown in FIG. 1.

In FIG. 5 is shown another embodiment of the cylindrical lens according to the invention. In this embodiment, the cylindrical lens is composed of a concave cylindrical lens 21. The concave cylindrical lens 21 is arranged between the manuscript 6 and the projecting lens 9 as shown by dotted lines in FIG. 1. This concave cylindrical lens 21 has an image magnification of 1/K in the scanning direction only of the manuscript 6 and the lens has a length L which is sufficient to optically cover the width of the manuscript 6, the length L being measured in a direction perpendicular to the scanning direction of the manuscript 6.

The insertion of the convex or concave cylindrical lens 20, 21 in the image projecting light passage 6, 8, 9, 4 and selection of a ratio of the peripheral speed of the screen drum 1 to the moving speed of the manuscript table 5 to 1/K makes it possible to correct the magnification of the dimension of the recorded picture image in the scanning direction and obtain a picture image having a correct aspect ratio.

In the present invention, the magnification of dimension to be corrected of the picture image is extremely small, so that the radius of curvature of the convex or concave cylindrical lens 20, 21 can be made considerably large. As a result, the lens 20, 21 can be produced by moulding synthetic resin, etc. on less expensive manner in mass production scale.

The invention is not limited to the above mentioned embodiments, but various changes and modifications may be made. For example, in the embodiment shown in FIG. 1, the manuscript 6 is disposed on the table 5 and the table 5 is moved in the direction shown by the arrow. But, the manuscript 6 may be disposed on a stationary table and the scanning optical system 7, 8 may be moved.

What is claimed is:

1. In a screen drum type electrographic apparatus comprising a photosensitive screen drum rotated at a constant speed, a flat-shaped record medium opposed to said photosensitive screen drum and fed along a rectilinear passage at a constant speed, a table for disposing a manuscript such as printed matter thereon, and an optical passage including an optical system mounted for relative movement with respect to said table for scanning said manuscript and a projecting lens, the ratio of the peripheral speed of said photosensitive screen drum to the feeding speed of said record medium being defined by 1/K where K is a value greater than 1, whereby a manuscript image is projected through said optical passage onto said screen drum by means of said projecting lens to form an electrostatic picture on said screen drum and a flow of ions directed through said screen drum toward said record medium is modulated by means of said electrostatic picture image formed on said screen drum to form a picture image on said record medium, the improvement in which said optical passage further comprises a cylindrical lens having a radius of curvature such that an image magnification in the scanning direction only is defined by 1/K, and said cylindrical lens having a length which is sufficient to optically cover the scanning width, the ratio of the peripheral speed of said screen drum to the speed of relative movement of said manuscript table with respect to said optical system being defined by 1/K.

2. A screen drum type electrographic apparatus according to claim 1 wherein said cylindrical lens is composed of a convex cylindrical lens formed of synthetic resin, said convex cylindrical lens being arranged between said projecting lens and said screen drum.

3. A screen drum type electrographic apparatus according to claim 1 wherein said cylindrical lens is composed of a concave cylindrical lens formed of synthetic resin, said concave cylindrical lens being arranged between said projecting lens and said manuscript.

* * * * *